US011486386B2

(12) United States Patent
Benson et al.

(10) Patent No.: US 11,486,386 B2
(45) Date of Patent: Nov. 1, 2022

(54) ACTIVE CONTROL VALVE FOR A FLUID PUMP

(71) Applicant: Cummins Inc., Columbus, IN (US)

(72) Inventors: Donald J. Benson, Columbus, IN (US); Bela Doszpoly, Columbus, IN (US); Paul Peavler, Columbus, IN (US)

(73) Assignee: CUMMINS INC., Columbus, IN (US)

( * ) Notice: Subject to any disclaimer, the term of this patent is extended or adjusted under 35 U.S.C. 154(b) by 77 days.

(21) Appl. No.: 17/070,299

(22) Filed: Oct. 14, 2020

(65) Prior Publication Data

US 2021/0131421 A1 May 6, 2021

Related U.S. Application Data

(60) Provisional application No. 62/931,422, filed on Nov. 6, 2019.

(51) Int. Cl.
*F04B 49/22* (2006.01)
*F02M 37/04* (2006.01)
*F04B 49/06* (2006.01)

(52) U.S. Cl.
CPC ..... *F04B 49/22* (2013.01); *F02M 37/04* (2013.01); *F04B 49/06* (2013.01)

(58) Field of Classification Search
CPC ..... F04B 49/06; F04B 49/22; F02M 37/04
See application file for complete search history.

(56) References Cited

U.S. PATENT DOCUMENTS 3,740,172 A * 6/1973 Ulbing ..... F04B 9/045 417/469
6,582,204 B2 * 6/2003 Gray, Jr. ..... F04B 19/003 417/364
6,652,247 B2 * 11/2003 Gray, Jr. ..... F04B 19/003 417/364
7,121,261 B2 10/2006 Kinose
7,325,537 B2 2/2008 Mueller et al.
7,546,831 B2 6/2009 Kaneko
7,610,902 B2 * 11/2009 Beardmore ..... F02M 59/44 417/540
8,333,336 B2 12/2012 Lewis et al.
8,662,056 B2 * 3/2014 Fedor, III ..... F02M 37/0047 123/446
9,200,605 B2 12/2015 Kim et al.
2018/0087479 A1 3/2018 Bean et al.

FOREIGN PATENT DOCUMENTS

WO 2012110540 A1 8/2012

* cited by examiner

*Primary Examiner* — Patrick Hamo
(74) *Attorney, Agent, or Firm* — Faegre Drinker Biddle & Reath LLP

(57) ABSTRACT

A fluid pump comprising a fluid inlet configured to receive a fluid, a plunger configured to reciprocate within a cylinder from a top dead center position to a bottom dead center position and back to the top dead center position during a given pumping cycle, a pumping chamber defined by the cylinder and the plunger, the pumping chamber being configured to receive the fluid from the fluid inlet, a control valve configured to open to allow fluid to be provided to the pumping chamber, and close after the plunger has passed the bottom dead center position, and a fluid outlet configured to receive a delivery amount of the fluid from the pumping chamber, wherein a first amount of fluid is configured to be provided to the pumping chamber, the first amount of fluid being greater than the delivery amount of fluid.

10 Claims, 6 Drawing Sheets

ACTIVE CONTROL VALVE FOR A FLUID PUMP

CROSS-REFERENCE TO RELATED APPLICATIONS

The present application claims priority to U.S. Provisional Patent Application Ser. No. 62/931,422, filed on Nov. 6, 2019, and entitled "ACTIVE CONTROL VALVE FOR A FLUID PUMP," the complete disclosure of which is expressly incorporated by reference herein.

TECHNICAL FIELD OF THE DISCLOSURE

The present disclosure relates to an active control valve for a fluid pump configured to control an input quantity to the fluid pump.

BACKGROUND OF THE DISCLOSURE

There is a consistent desire to improve the performance of engines. With regard to fluid pumps, controlling the quantity of fluid which is input into the pump can provide improved performance of the engine overall. When the quantity of fluid input into the pump is much greater than an amount of fluid delivered from the pump, a large fluid spill quantity, or amount of excess fluid spilled from the pumping chamber back to the fluid inlet and fluid source is present, and efficiency of the engine is reduced, inlet circuit pressure fluctuations are increased, the temperature of the fluid is increased, and, when the pumped fluid is fuel and the pump's lubricating fluid differs from fuel, the lubricating fluid to fuel and fuel to lubricating fluid transfer is increased. On the other hand, if there is insufficient fluid spill quantity associated with each pumping event, cavitation damage potential is increased and downstream pressure variations may be increased due to an increase in delivery quantity variations. Thus, it would be beneficial to have an active control valve for a fluid pump configured to control an input quantity to the fluid pump such that a small amount of spilled quantity is provided beyond the amount of fluid needed to be delivered from the pump, but not so much that the problems outlined above occur.

SUMMARY OF THE DISCLOSURE

In one embodiment of the present disclosure, a fluid pump is provided. The fluid pump comprises a fluid inlet configured to receive a fluid, a plunger configured to reciprocate within a cylinder from a top dead center position to a bottom dead center position and back to the top dead center position during a given pumping cycle, a pumping chamber defined by the cylinder and the plunger, the pumping chamber being configured to receive the fluid from the fluid inlet, a control valve configured to open to allow fluid to be provided to the pumping chamber, and close after the plunger has passed the bottom dead center position, and a fluid outlet configured to receive a delivery amount of the fluid from the pumping chamber, wherein a first amount of fluid is configured to be provided to the pumping chamber, the first amount of fluid being greater than the delivery amount of fluid.

In another embodiment of the present disclosure, a fluid pump configured to provide a delivered quantity of fluid to an engine during a pumping event is provided. The fluid pump comprises a fluid inlet configured to receive a fluid, a plunger configured to reciprocate within a cylinder from a top dead center position to a bottom dead center position and back to the top dead center position during the pumping event, a pumping chamber defined by the cylinder and the plunger, the pumping chamber configured to receive the fluid from the fluid inlet, a control valve configured to open to allow a first quantity of fluid to be provided to the pumping chamber, and close after the plunger has passed the bottom dead center position, and a fluid outlet configured to receive the delivered quantity of the fluid from the pumping chamber, wherein the delivered quantity of the fluid is less than a sum of the first quantity of fluid provided to the pumping chamber and a leakage quantity from the pumping chamber during the pumping event.

In a further embodiment of the present disclosure, a fluid system coupled to an engine is provided. The fluid system comprises a fluid source, and a fluid pump fluidly coupled to the fluid source and configured to deliver an amount of fluid to the engine, wherein the fluid pump comprises a fluid inlet configured to receive fluid from the fluid source, a plunger configured to reciprocate within a cylinder from a top dead center position to a bottom dead center position and back to the top dead center position during a given pumping cycle, a pumping chamber defined by the plunger and the cylinder, the pumping chamber configured to receive the fluid from the fluid inlet, a control valve configured to open to allow a first amount of the fluid to be provided to the pumping chamber, the first amount of the fluid including the amount of fluid to be delivered to the engine and an amount of fluid to be spilled from the pumping chamber back into the fluid source, and a fluid outlet configured to receive the amount of fluid to be delivered to the engine from the pumping chamber, wherein the amount of fluid to be delivered to the engine is less than a sum of the first amount of fluid provided to the pumping chamber and the amount of fluid to be spilled from the pumping chamber during the pumping event.

BRIEF DESCRIPTION OF THE DRAWINGS

Advantages and features of the embodiments of this disclosure will become more apparent from the following detailed description of exemplary embodiments when viewed in conjunction with the accompanying drawings, wherein.

Figure 1:
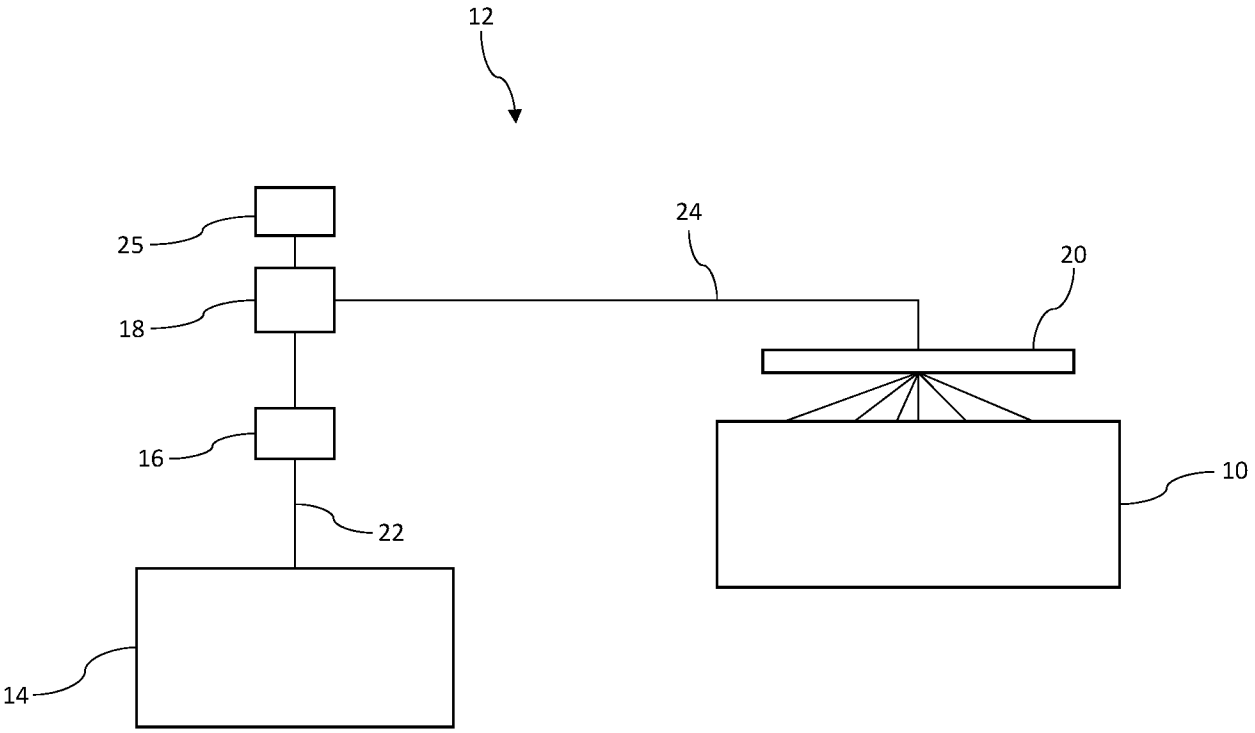
FIG. 1 shows a diagram of a fluid system and an engine of the present disclosure.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate embodiments of the disclosure, in one form, and such exemplifications are not to be construed as limiting the scope of the disclosure in any manner.

DETAILED DESCRIPTION OF THE DRAWINGS

Referring to FIG. 1, a diagram of an engine 10 and a fluid system 12 is generally shown. Fluid system 12 generally includes a fluid source 14, a fluid filter 16, and a fluid pump 18 for providing fluid to engine 10. In various embodiments, fluid system 12 further includes a fluid rail 20 coupled to engine 10, and fluid pump 18 is configured to deliver fluid to fluid rail 20. A low-pressure fluid line 22 fluidly couples fluid source 14 to fluid pump 18, and fluid filter 16 is positioned along low pressure fluid line 22 between fluid source 14 and fluid pump 18. A high-pressure fluid line 24 fluidly couples fluid pump 18 to engine 10 and/or fluid rail 20. In one embodiment, fluid system 12 is a fuel system configured to provide fuel to engine 10.

Figure 2:
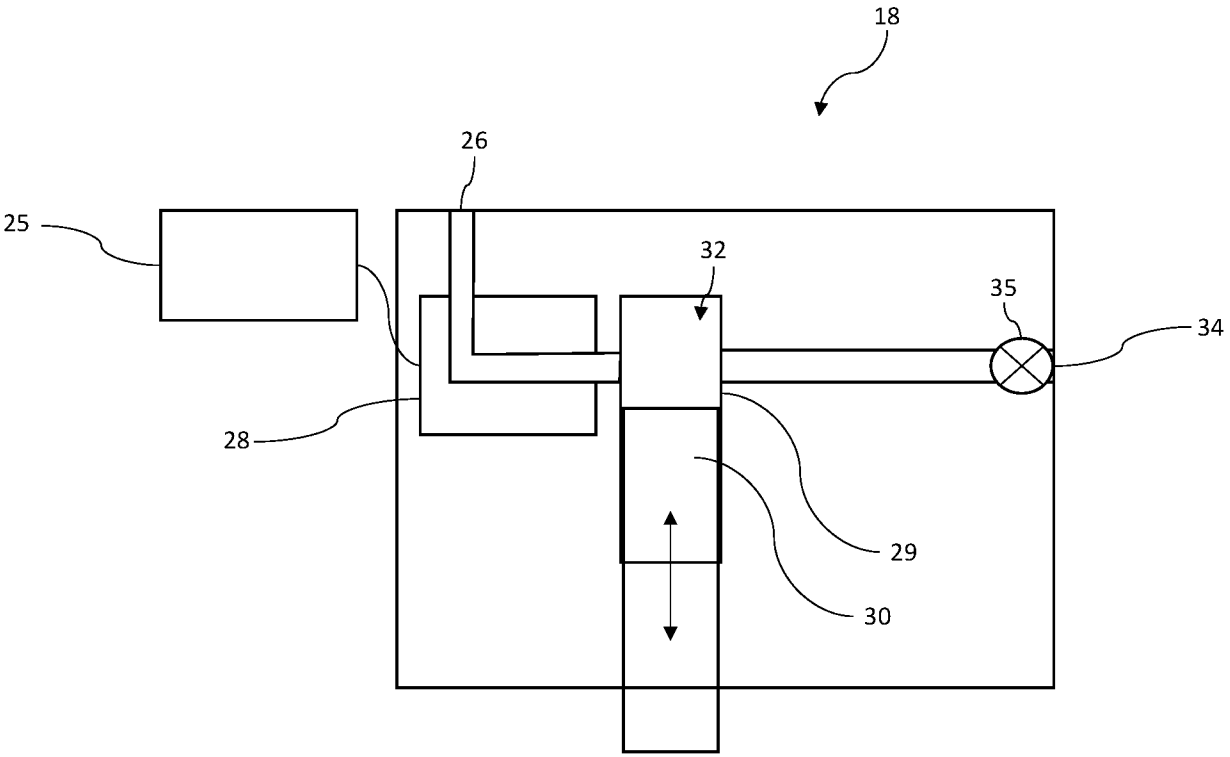
FIG. 2 shows a diagram of a fluid pump of the fluid system of FIG. 1.

With reference now to FIG. 2, fluid pump 18 generally includes a fluid input 26, a control valve 28, a cylinder 29, a plunger 30, a pumping chamber 32 defined by cylinder 29 and plunger 30, a fluid output 34, and an outlet check valve 35 positioned between pumping chamber 32 and fluid output 34. Fluid input 26 is coupled to low-pressure fluid line 22 (FIG. 1) of fluid system 12 and provides fluid to pumping chamber 32 as allowed by control valve 28 and/or plunger 30. Control valve 28 is positioned between low pressure fluid line 22 and pumping chamber 32, and is configured to control the amount and timing of fluid supplied to pumping chamber 32 of fluid pump 18. In various embodiments, an electronic control module (ECM) 25 is provided to operate control valve 28. Plunger 30 is positioned below pumping chamber 32 and reciprocates within cylinder 29 to increase and decrease the total volume and/or pressure of pumping chamber 32.

In various embodiments, fluid pump 18 further includes a cam (not shown) that rotates relative to a camshaft (not shown) of engine 10. Plunger 30 may be a forcibly retracted plunger that includes a spring (not shown) that causes plunger 30 to reciprocate with the cam of fluid pump 18 from a top dead center (TDC) position 36 (FIGS. 3-6) to a bottom dead center (BDC) position 38 (FIGS. 3-6) and back to top dead center position 36 (FIGS. 3-6) such that fluid entering and leaving pumping chamber 32 is not the driving factor in the reciprocation of plunger 30. Instead, movement of plunger 30 is affected by the force of the spring, rather than merely moving between BDC and TDC based on the volume and/or pressure of fluid within pump chamber 32.

In other various embodiments, plunger 30 may be a non-retracted or floating plunger that is disconnected from the cam of fluid pump 18. Non-retracted or floating plunger 30 may generally include a tappet assembly (not shown) that follows a cam surface of the cam when the cam retracts from TDC 36 to BDC 38 and back to TDC 36. With this embodiment, plunger 30 may move with the volume and/or pressure of fluid within pumping chamber 32 and movement thereof may not be affected by an external source.

As seen in FIGS. 3-6, pumping chamber 32 typically has an amount of residual or trapped fluid 40 such that depressurized position 44 is slightly lower than TDC position 36. If residual or trapped fluid 40 in pumping chamber 32 is present in an amount greater than a minimum quantity of fluid required to just fill pumping chamber 32 when plunger 30 is at TDC, then the residual or trapped fluid 40 is pressurized as plunger 30 is pushed to TDC portion 36, or a pressurized position, creating a residual pressure within pumping chamber 32.

Figure 3:
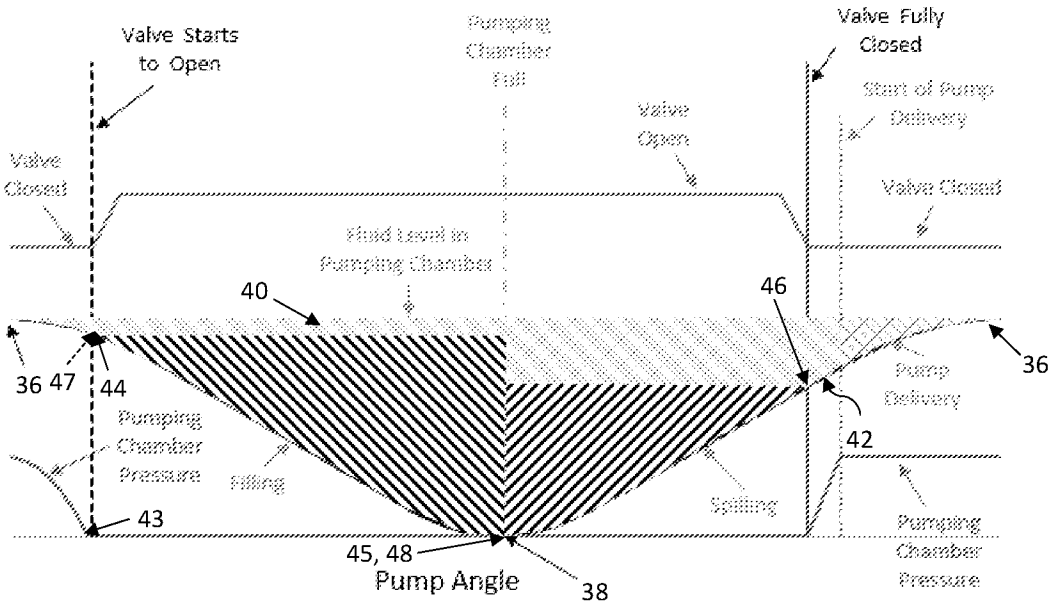
FIG. 3 PRIOR ART
FIG. 3 shows a graphical diagram of a fluid level, a valve position, and a pumping chamber pressure of a fluid pump of the prior art relative to a pump angle of the fluid pump when a spill quantity is larger than optimal.

With reference now to FIG. 3, a common method in the prior art for controlling a quantity of fluid delivered to engine 10 from fluid pump 18 includes opening control valve 28 as soon as the residual pressure in pumping chamber 32 drops to a level at which control valve 28 can be opened after TDC position 36 (i.e., after the residual or trapped fluid is no longer pressurized), which occurs at a depressurized position 44 which coincides with a pump angle 43 at which the pumping chamber pressure drop ends. Fluid from fluid inlet 26 supplied from fluid source 14 then begins to fill pumping chamber 32 at a filling start position 47 as the cam of fluid pump 18 and plunger 30 descend to BDC position 38. If the combination of the effective open flow area of control valve 28 and the pressure differential between the supply pressure and the pumping chamber pressure is sufficient for the pump geometry and the pump operating speed, then the fluid entering pumping chamber 32 will continue to fully fill pumping chamber 32 as it continues to expand until position 48 when filling ends and the cam of fluid pump 18 and plunger 30 reach BDC position 38. At BDC position 38, pumping chamber 32 is fully filled. After the cam of fluid pump 18 and plunger 30 reach BDC position 38, fluid in pumping chamber 32 then begins to flow/spill at position 45 back past control valve 28 into fluid inlet 26 and/or fluid source 14. If the control system desires some fluid to be delivered from fluid pump 18 during the given pumping stroke, then control valve 28 is fully closed at a pump angle after BDC position 38 and spilling ends at position 46 when valve 28 closes. After control valve 28 is closed, fluid in pumping chamber 32 is compressed and pressurized during a portion 42 of the pumping stroke until the pressure in pumping chamber 32 exceeds the pump outlet pressure which initiates delivery of fluid through fluid outlet 34. The pumping chamber pressure keeps control valve 28 closed to prevent additional spilling and delivery continues until approximately TDC position 36. The greater the quantity of desired pump delivery, the earlier the valve closes relative to BDC position 38. At maximum delivery from pump 18, there is no spilled quantity since control valve 28 closes as soon as pumping chamber 32 is fully filled. At zero pump output delivery from pump 18, control valve 28 is commanded to open during the entire cycle and all fluid which flows into pumping chamber 32 from angle 43 to BDC 38 is spilled back to fluid inlet 26 and/or fluid source 14 as plunger 30 moves from BDC 38 to TDC 36. The prior art method of delivering fluid shown in FIG. 3 allows more fluid than necessary to be delivered and the excess fluid not required for combustion defines the spill quantity of unneeded fluid. The method of FIG. 3 ensures sufficient fluid is provided to engine 10 but provides a large amount of excess fluid (e.g., the spill quantity) by over-delivering fluid to pumping chamber 32. As such, the prior art fluid delivery method of FIG. 3 creates inefficiencies in fluid system 12 as well as reduces the efficiency of the engine, increases inlet circuit pressure fluctuations, increases the temperature of the fluid, and, increases transfer between lubricating fluid to fuel and fuel to lubricating fluid when the pumped fluid is fuel and the pump's lubricating fluid differs from fuel.

Figure 4:
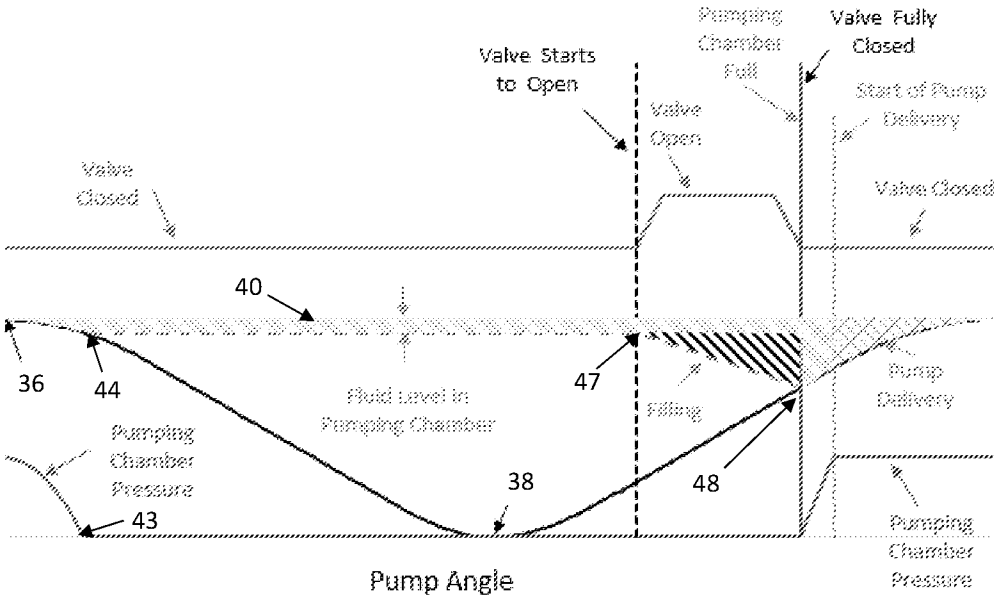
FIG. 4 PRIOR ART
FIG. 4 shows a graphical diagram of a fluid level, a valve position, and a pumping chamber pressure of a fluid pump of the prior art relative to a pump angle of the fluid pump when a spill quantity is zero.

Referring now to FIG. 4, another common method in the prior art for controlling a quantity of fluid delivered to engine 10 from fluid pump 18 includes providing precisely the exact amount of fluid desired to be delivered to engine 10 to pumping chamber 32 during the intake phase such that the exact quantity of fluid is delivered through fluid outlet 24 during a given pumping stroke. To limit the filling fluid quantity that is input to pumping chamber 32, control valve 28 is controlled such that only as much fluid as is desired to be delivered to engine 10 is provided to pumping chamber 32 of fluid pump 18 during the given pumping stroke. For instance, control valve 28 is not opened until after BDC position 38 and just long enough to allow the precise amount of fluid to be received within pumping chamber 32. Some of the advantages of this prior art method relative to the prior art method described above in relation to FIG. 3 include: an increased part load efficiency improvement, a reduction in the heating of the fluid, a reduction in the peak pressure in fluid system 12, and a more stable pressure in fluid system 12. However, some of the disadvantages of this method include an increased likelihood of vapor in pumping chamber 32 after the closing of control valve 28 due to insufficient fluid being present in pumping chamber 32 which can lead to cavitation damage in pump 18 and quantity instability between pumping events. Additionally, if there are any losses in the system prior to or during the delivery of the fluid to pumping chamber 32, then less than the desired amount of fluid is supplied to engine 10, thereby negatively impacting combustion of engine 10.

In view of the foregoing disadvantages of the fluid delivery methods of FIGS. 3 and 4, there is a need for a fluid delivery system and method which provides the desired quantity of fluid to pumping chamber 32 while minimizing the spill quantity of fluid.

Figure 5:
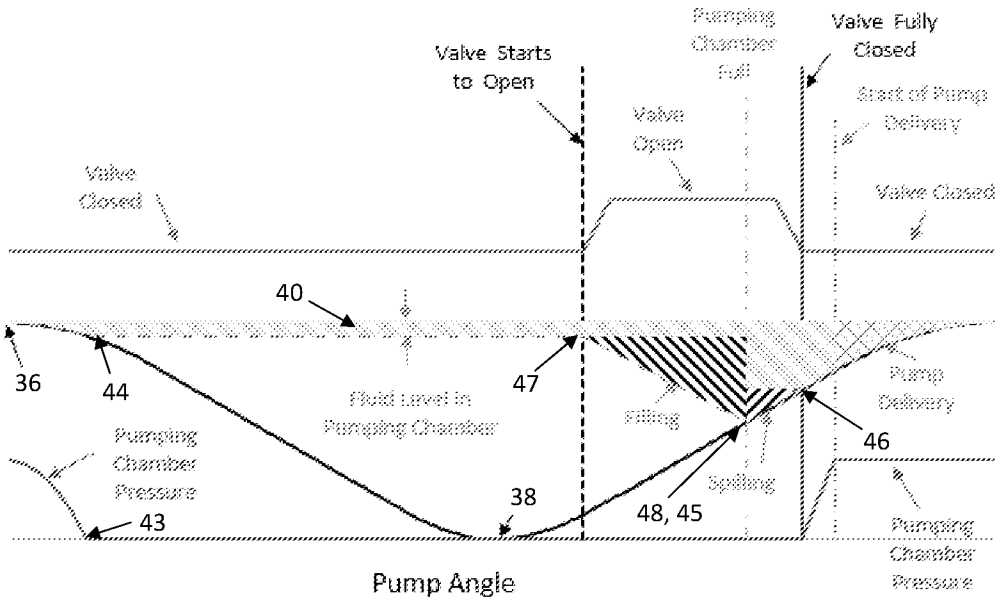
FIG. 5 shows a first graphical diagram of a fluid level, a valve position, and a pumping chamber pressure of the fluid pump of FIG. 2 relative to a pump angle of the fluid pump.
Figure 6:
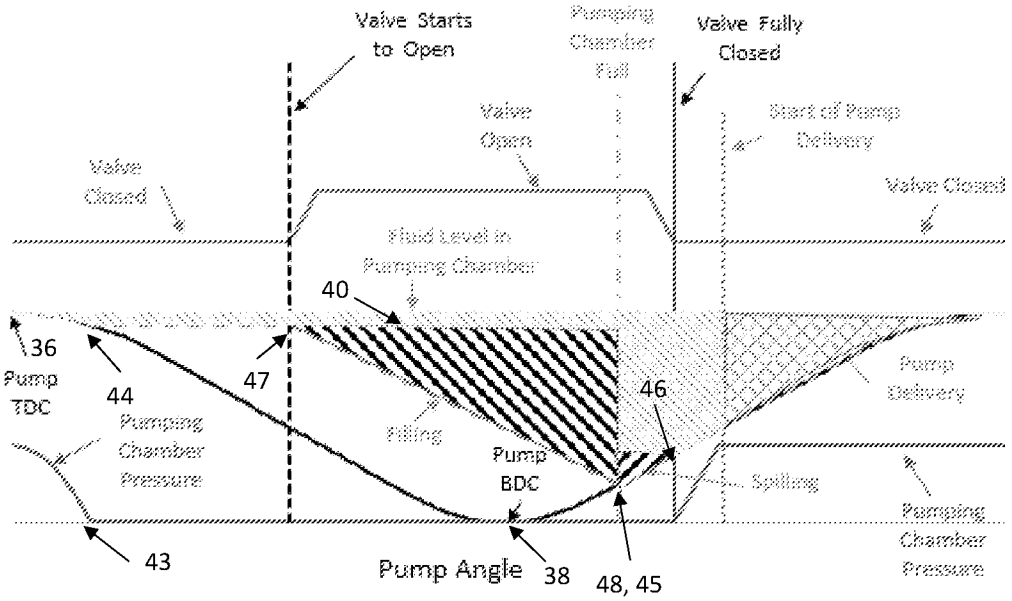
FIG. 6 shows a second graphical diagram of a fluid level, a valve position, and a pumping chamber pressure of the fluid pump of FIG. 2 relative to a pump angle of the fluid pump.

With reference now to FIGS. 5 and 6, a method for controlling a quantity of fluid delivered to engine 10 from fluid pump 18 of the present disclosure will be discussed and addresses the foregoing need. The method of the present disclosure includes opening control valve 28 at a point in time such that the amount of fluid input into pumping chamber 32 during a given intake phase is slightly greater than the desired amount of fluid which is to be pumped out of pumping chamber 32 and into engine 10 through fluid output 26, whether that be before or after BDC position 38, when the desired amount of fluid is less than the maximum delivery quantity. However, control valve 28 of the present disclosure is always closed after BDC position 38 when delivering less than the maximum delivery quantity. As such, pumping chamber 32 is filled with the quantity of fluid desired to be delivered to engine 10 along with only a small excess amount of fluid beyond this desired amount such that the small excess amount of fluid beyond the desired quantity in pumping chamber 32 flows/spills back past control valve 28 into fluid inlet 26 and/or fluid source 14 before control valve 28 is fully closed and the desired fluid quantity is then supplied to engine 10. This method ensures that pumping chamber 32 is fully filled without a substantial amount of spilled fluid, but with a sufficient amount of spilled fluid to maintain a stable pumping quantity delivery when the desired fluid quantity is less than the maximum delivery quantity. Relative to the prior art method described above in reference to FIG. 4, control valve 28 may be opened before or after BDC position 38 and closed at BDC position 38 when providing the maximum delivery quantity, but control valve 28 is closed after BDC position 38 when providing less than the maximum delivery quantity such that the amount of fluid supplied to pumping chamber 32 is slightly greater than the desired amount of fluid delivered to engine 10 or pumped out of pumping chamber 32. In this way, the fluid delivery method and system of the present application ensure that the desired fluid quantity is supplied to engine 10 by providing more than the desired quantity when that quantity is less than maximum and accounting for any losses in the system but also minimizes the overage amount compared to that shown in the prior art method of FIG. 3. As such, FIGS. 5 and 6 disclose a fluid delivery system which is efficient, accounts for losses in the system, delivers the desired amount of fluid to engine 10, and minimizes excess and unneeded fluid.

In various embodiments, the amount of fluid input into pumping chamber 32 is calculated as a sum of the delivered quantity to be pumped in that pumping event, the targeted spill quantity, and a barrel/plunger annular clearance leakage quantity. This quantity of fluid metered into pumping chamber 32 is a function of factors such as the supply pressure characteristics, the control valve response characteristics, the valve effective flow area, the operating speed, and the residual pumping chamber fluid from the prior pumping stroke.

As disclosed herein, the method of the present disclosure has several advantages. For instance, this method reduces the likelihood of vapor in pumping chamber 32 after the closing of control valve 28 which can lead to cavitation damage in pump 18 by spilling a sufficient quantity of the potential fluid and vapor mixture back to the supply to reduce the likelihood of cavitation damage relative to the method discussed above in FIG. 4. This method also acts to improve the robustness of the pumping and pressure control by acting to reduce the sensitivity of the pumped quantity of each pumping event to the filled quantity variations. The pumped quantity is controlled more by the valve closing event which determines the pumping quantity more than the fill quantity does for the control methodology which targets for some of the fluid to be spilled as the pumping chamber volume decreases after pump BDC.

Furthermore, for pump configurations in which a lubrication fluid in the cam of fluid pump 18 differs from the fluid provided to pumping chamber 32, the method of this disclosure enables an increased robustness of the control of the pumping quantity while simultaneously acting to reduce the fluid transfer between the lubrication fluid and the fluid supplied to pumping chamber 32. In these pump configurations, the method of the present disclosure allows the pumping plunger to axially travel a significantly shorter distance for all pump strokes in which the quantity of pump delivery is less than its full capacity. This reduced plunger travel acts to reduce the magnitude of the transfer between the lubrication fluid and the fluid supplied to pumping chamber 32.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A fluid pump comprising:

a fluid inlet configured to receive a fluid;

a plunger configured to reciprocate within a cylinder from a top dead center position to a bottom dead center position and back to the top dead center position during a given pumping cycle;

a pumping chamber defined by the cylinder and the plunger, the pumping chamber being configured to receive the fluid from the fluid inlet;

a control valve configured to open to allow fluid to be provided to the pumping chamber, and close after the plunger has passed the bottom dead center position; and a fluid outlet configured to receive a delivery quantity of the fluid from the pumping chamber, wherein an input quantity is configured to be provided to the pumping chamber, the input quantity of fluid being greater than the delivery quantity of fluid;

wherein the input quantity is a sum of the delivery quantity for a pumping event, a target spill quantity, and a plunger annular clearance leakage quantity.

2. The fluid pump of claim 1, wherein the plunger is a forcibly retracted plunger.

3. The fluid pump of claim 1, wherein the plunger is a floating plunger.

4. The fluid pump of claim 1 further comprising an outlet check valve between the pumping chamber and the fluid outlet.

5. A fluid pump configured to provide a delivered quantity of fluid to an engine during a pumping event, the fluid pump comprising:

a fluid inlet configured to receive a fluid;

a plunger configured to reciprocate within a cylinder from a top dead center position to a bottom dead center position and back to the top dead center position during the pumping event;

a pumping chamber defined by the cylinder and the plunger, the pumping chamber configured to receive the fluid from the fluid inlet;

a control valve configured to open to allow an input quantity of fluid to be provided to the pumping chamber, and close after the plunger has passed the bottom dead center position; and a fluid outlet configured to receive the delivered quantity of the fluid from the pumping chamber, wherein the delivered quantity of the fluid is less than a sum of the input quantity of fluid provided to the pumping chamber and a target spill quantity from the pumping chamber during the pumping event;

wherein the input quantity is a sum of the delivered quantity for the pumping event, the target spill quantity, and a plunger annular clearance leakage quantity.

6. The fluid pump of claim 5, wherein the plunger is a floating plunger.

7. The fluid pump of claim 5, wherein the plunger is a forcibly retracted plunger.

8. The fluid pump of claim 5 further comprising an outlet check, valve between the pumping chamber and the fluid outlet.

9. A fluid system coupled to an engine, the fluid system comprising:

a fluid source; and a fluid pump fluidly coupled to the fluid source and configured to deliver a quantity of fluid to the engine, wherein the fluid pump comprises:

a fluid inlet configured to receive fluid from the fluid source;

a plunger configured to reciprocate within a cylinder from a top dead center position to a bottom dead center position and back to the top dead center position during a given pumping cycle;

a pumping chamber defined by the plunger and the cylinder, the pumping chamber configured to receive the fluid from the fluid inlet;

a control valve configured to open to allow an input quantity of the fluid to be provided to the pumping chamber, the input quantity of the fluid including a quantity of fluid to be delivered to the engine and a quantity of fluid to be spilled from the pumping chamber back into the fluid source; and a fluid outlet configured to receive the quantity of fluid to be delivered to the engine from the pumping chamber, wherein the quantity of fluid to be delivered to the engine is less than a sum of the input quantity of fluid provided to the pumping chamber and the quantity of fluid to be spilled from the pumping chamber during a pumping event;

wherein the input quantity is a sum of the quantity of fluid to be delivered to the engine from the pumping chamber, the quantity of fluid to be spilled from the pumping chamber back into the fluid source, and a plunger annular clearance leakage quantity.

10. The fluid system of claim 9, wherein the control valve is coupled to an electronic control module.

* * * * *